US005131338A

United States Patent [19]

Vogel et al.

[11] Patent Number: 5,131,338

[45] Date of Patent: Jul. 21, 1992

[54] NEEDLE THREAD REGULATING MECHANISM FOR SEWING MACHINES

[75] Inventors: Hanspeter Vogel; Nicklaus Wacker, both of Steckborn, Switzerland

[73] Assignee: Fritz Gegauf Aktiengesellschaft, Steckborn, Switzerland

[21] Appl. No.: 673,733

[22] Filed: Mar. 22, 1991

[30] Foreign Application Priority Data

Apr. 5, 1990 [CH] Switzerland ..... 01153/90

[51] Int. Cl.[5] ..... D05B 49/00

[52] U.S. Cl. ..... 112/241; 112/247

[58] Field of Search ..... 112/241, 246, 247, 302

[56] References Cited

U.S. PATENT DOCUMENTS

| | | | |
|---|---|---|---|
| 197,107 | 11/1877 | Cushman | 112/247 |
| 875,610 | 12/1907 | Parks | 112/247 |
| 994,509 | 6/1911 | Gray | 112/247 X |
| 1,245,338 | 11/1917 | Hayes | 112/247 |
| 1,370,228 | 3/1921 | Scully et al. | 112/247 |
| 4,411,395 | 12/1983 | Rodda | 112/254 |
| 4,724,782 | 2/1988 | Reber | 112/192 |
| 4,736,698 | 4/1988 | Inagaki | 112/247 |
| 4,817,545 | 4/1989 | Mikuni et al. | 112/241 |
| 4,856,443 | 8/1989 | Ogawa | 112/241 |
| 4,907,517 | 3/1990 | Hanyu et al. | 112/241 X |

FOREIGN PATENT DOCUMENTS

| | | |
|---|---|---|
| 45813 | 5/1888 | Fed. Rep. of Germany . |
| 421673 | 4/1967 | Switzerland . |

*Primary Examiner*—Werner H. Schroeder
*Assistant Examiner*—Paul C. Lewis
*Attorney, Agent, or Firm*—Peter K. Kontler

[57] ABSTRACT

A regulating mechanism for needle thread between a standard thread tensioning device in the head of the upper arm of a sewing machine and the eye of the reciprocable needle employs a lever-shaped takeup member which is oscillated in the head in synchronism with the movements of the needle, and a wire spring which is mounted directly on the takeup member. The spring has a U-shaped thread engaging portion which surrounds and cooperates with a hook-shaped arm of the takeup member to define a passage for needle thread. The spring tensions the thread during certain stages of each stitch forming step.

19 Claims, 1 Drawing Sheet

NEEDLE THREAD REGULATING MECHANISM FOR SEWING MACHINES

BACKGROUND OF THE INVENTION

The invention relates to sewing machines in general, and more particularly to improvements in mechanisms for regulating or controlling the needle thread between a spool or another suitable source and the eye of the needle. Still more particularly, the invention relates to improvements in mechanisms wherein the needle thread is acted upon by resilient means to be maintained under requisite tension.

When the needle of a sewing machine descends toward and penetrates into the fabric on the lower arm of a sewing machine, that length of needle thread which is located ahead of the eye of the needle must be controlled to prevent the development of short-lasting pronounced tensional stresses such as could adversely influence the making of stitches. To this end, it is customary to employ an oscillatory takeup lever which is movable up and down in substantial synchronism with the needle in such a way that the length of needle thread ahead of the eye of the needle cannot undergo an abrupt and pronounced tensioning action and is also prevented from becoming too loose so that it could form a relatively large loop which is likely to be wound around the needle.

A drawback of presently known takeup levers for the needle thread ahead of the needle is that they cannot accurately control the thread during each and every stage of a stitch forming step. Therefore, it is customary to employ a spring which compensates for the inability of the lever to control the needle thread during certain stages of each stitch forming operation. In addition, such spring is called upon to perform one or more additional functions in the course of a stitchforming step, depending upon the nature of the takeup lever or another takeup member. Thus, when the takeup member moves downwardly toward the fabric on the lower arm of the sewing machine, the needle thread tends to become loose and the spring is called upon to temporarily take up the thread until the eye of the needle penetrates into the fabric. This is desirable and advantageous because the spring ensures that the needle cannot penetrate into loose needle thread, that the thread cannot be wound around the lower end of the needle, and that the thread cannot become twisted immediately ahead of the eye in the lower end portion of the needle. This reduces the likelihood that the thread would break and/or that an overly loose or overly taut needle thread could interfere with the making of satisfactory stitches.

The spring is called upon to perform a different function shortly before the looptaker casts a freshly formed and enlarged needle thread loop. At such time, the spring ensures gentle and shock-free withdrawal of the needle thread loop before the takeup member becomes active to rise at an elevated speed and to pull the needle thread upwardly and into the fabric.

Still further, the spring can be used to ensure that the looped thread is withdrawn at the instant when the finger of the bobbin and the rotation stopping member (which interrupts the rotational movement of the bobbin) are located exactly opposite each other. This ensures a gentle and noise-free withdrawal of the thread. As a rule, the pull of the spring upon the thread should not be very pronounced; however, the spring should be capable of rapidly altering the tension of the thread when such tensioning is desired and the tensioning action must be carried out without losses, such as slippage.

In view of the aforediscussed numerous important and advantageous functions of the spring, the mounting of such spring, the configuration and dimensions of the spring as well as the location of the spring are of considerable importance because they can greatly influence the quality of stitch making. In addition, it is desirable to locate the spring in such a way that it permits rapid, convenient and reliable insertion of the thread, i.e., the person in charge of using the sewing machine need not pay much attention to the spring during introduction of the thread into the prescribed path between the source of such thread and the eye of the needle.

U.S. Pat. No. 4,856,443 to Ogawa et al. discloses a needle thread tensioning device which is designed to enable a spring to maintain the needle thread under tension during a certain stage of each stitch forming step. The takeup member for needle thread is mounted in such a way that its thread engaging portion is adjacent the locus of passage of the needle thread loop along the member which is used to stop rotation of the bobbin. The purpose of the patented thread tensioning device is to ensure constant withdrawal of needle thread from the spool and to avoid the generation of pronounced noise. A drawback of the device of Ogawa et al. is that it cannot properly take up loose needle thread during the initial stage of downward movement of the needle and cannot prevent the accumulation of loose needle thread immediately adjacent the eye of the needle. Moreover, the construction which is proposed by Ogawa et al. is rather bulky, complex and expensive.

Commonly owned Swiss Pat. No. 421 673 to Gegauf discloses a needle thread regulating mechanism which employs a thread deflecting spring. A drawback of this proposal is that the regulating mechanism is quite complex and that the extent to which the thread is looped on the spring varies during different stages of a stitching step with attendant changes of friction between the spring and the thread.

A different thread regulating mechanism is disclosed in German Pat. No. 45813 to Gebr. Nothmann. This patent proposes to subject needle thread to an additional tensioning action prior to as well as in the course of a stitch forming step.

Other thread regulating mechanisms are disclosed in U.S. Pat. No. 4,422,395 to Singer and in U.S. Pat. No. 4,736,698 to Brother.

OBJECTS OF THE INVENTION

An object of the invention is to provide a simple, reliable and inexpensive regulating mechanism for needle thread in a sewing machine.

Another object of the invention is to provide a novel and improved spring which can be used in the thread regulating mechanism.

A further object of the invention is to provide a novel and improved combination of spring and takeup member for needle thread in a sewing machine.

An additional object of the invention is to provide a mechanism which can properly regulate the tensioning of needle thread during each and every stage of a stitch forming step.

Still another object of the invention is to provide a sewing machine which embodies the above outlined needle thread regulating mechanism.

A further object of the invention is to provide a regulating mechanism which simplifies the insertion of needle thread into the prescribed path between a spool and the eye of the needle in a sewing machine.

An additional object of the invention is to provide novel and improved means for separably but reliably coupling the spring to the takeup member for needle thread in a sewing machine.

SUMMARY OF THE INVENTION

The invention resides in the provision of a mechanism which is installed in a sewing machine and includes a needle having an eye for needle thread, a needle bar or other suitable means for reciprocating the needle, and means for regulating the supply of needle thread between a source (e.g., a rotary spool) of needle thread and the needle. The regulating means comprises a mobile thread takeup member and means for intermittently tightening the thread at the takeup member. The tightening means comprises a spring which is mounted directly on and shares the movements of the takeup member. Such takeup member can constitute or include a lever with at least two arms.

The mechanism can further comprise a standard tensioning device which is designed to tension the needle thread between the spool and the regulating means.

The regulating means further comprises means for moving the takeup member in synchronism with the needle, and such moving means can comprise a link train. The arrangement is preferably such that the moving means is designed to impart to the takeup member and to the spring substantially translatory movements which are synchronized with the movements of the needle.

The takeup member can be provided with a protuberance (e.g., in the form of a cylindrical stud), and the spring preferably includes a portion which is non-rotatably mounted on the protuberance. The portion of the spring can surround the protuberance and (if the spring is made of wire) can consist of an annulus of convolutions which can be simply slipped onto the protuberance of the takeup member. An end portion of the spring can extend from the annulus to at least partially surround a portion of the takeup member for the purpose of preventing rotation of convolutions around the protuberance.

The spring and the takeup member comprise thread engaging portions which preferably define a passage for needle thread. One of these thread engaging portions can be located within the other thread engaging portion; for example, the spring can comprise a substantially U-shaped thread engaging portion which surrounds the thread engaging portion of the takeup member. The takeup member can be formed with a socket (e.g., in the form of a bore or hole which is coaxial with the aforementioned protuberance), and a tip (e.g., a bent-over free end) of the thread engaging portion extends into such socket. The thread engaging portion of the takeup member can comprise or constitute a pallet (e.g., a hook-shaped pallet), and the thread engaging portion of the spring cooperates with the pallet to define the aforementioned passage in such a way that a portion of the needle thread is confined between the pallet and the thread engaging portion of the spring which latter preferably surrounds the pallet.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain presently preferred specific embodiments with reference to the accompanying drawing.

DESCRIPTION OF THE PREFERRED EMBODIMENTS

Figure 1:
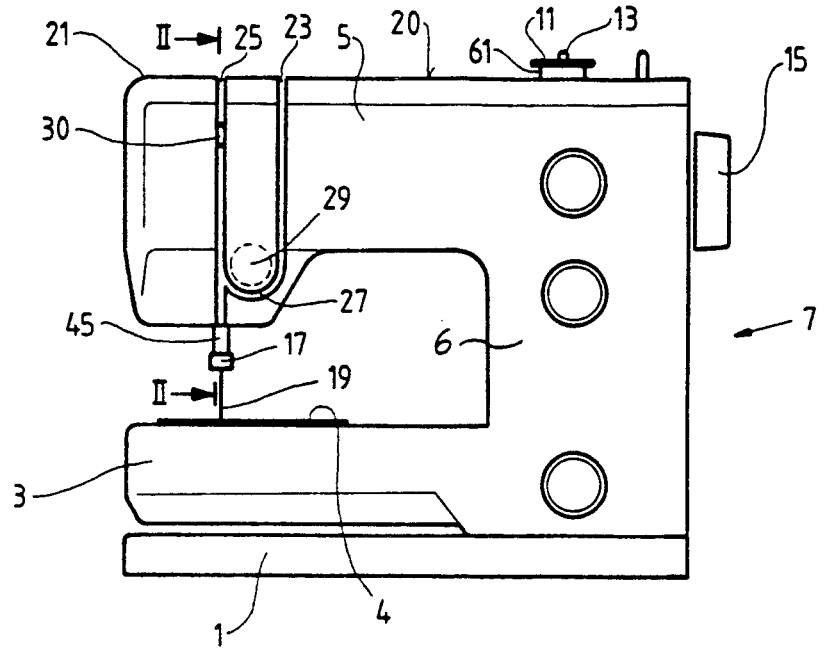
FIG. 1 is a schematic elevational view of a sewing machine with the improved needle thread regulating mechanism installed in the upper arm of the machine.

The sewing machine 7 which is shown in FIG. 1 comprises a base or bed 1 beneath a lower arm 3, an upper arm 5 which is integrally connected with the lower arm 3 by a standard 6 and includes a head 21 at its free end, and a customary handwheel 15 which is rotatably mounted on the standard 6. The upper arm 5 carries a post 13 for a spool 11 constituting a source of supply of needle thread 61. The underside of the head 21 of the upper arm 5 is provided with an opening (shown in FIG. 2) for a needle bar 45 which constitutes a means for reciprocating a needle 19 so that the needle is repeatedly caused to penetrate into and through and to be withdrawn from a fabric 4 on the upper side of the adjacent portion of the lower arm 3. A needle holder 17 is provided to detachably couple the upper end portion of the needle 19 with the lower end portion of the needle bar 45, and the lower end portion of the needle 19 is provided with a customary eye (not shown) for needle thread 61.

The head 21 of the upper arm 5 is formed with two parallel vertical slots 23 and 25. The slot 25 extends all the way between the upper side 20 and the underside of the upper arm 5 (see FIG. 2). The upper end portion of the slot 23 extends into a slot which is provided in the upper side 20 of the upper arm 5. The lower end of the slot 23 communicates with an arcuate (particularly semicircular) slot 27 which further communicates with an intermediate portion of the slot 25. The slots 23, 25, 27 surround the location for a standard needle thread tensioning device 29 which is installed in the interior of the hollow upper arm 5 and tensions the needle thread 61 between the spool 11 and the thread engaging portion or arm 30 of a three-armed lever-shaped mobile takeup member 36 forming part of the improved thread regulating mechanism 31 and being installed between the tensioning device 29 and the eye of the needle 19. The thread engaging arm 30 is located at the slot 25 and is movable up and down as a result of a substantially translatory movement which is imparted to the takeup member 36 by a moving means including interconnected links 41 and 43 both installed in the interior of the upper arm 5. An intermediate position of the arm 30 is shown in FIG. 2 by phantom lines, as at 30', and an upper end position of the arm 30 is also shown in FIG. 2 by phantom lines, as at 30''.

The regulating mechanism 31 in the arm 5 further comprises a link 33 which is pivotable about the horizontal axis of a fixed shaft 35 and is articulately connected to the adjacent arm of the takeup member or lever 36 by a horizontal pin 37. The downwardly extending arm of the takeup member 36 is articulately connected with the adjacent end of the link 41 by a horizontal pin 39. The link 41 can be said to constitute a crank arm which is rockable about a fixed horizontal axis to impart to the takeup member 36 a substantially translatory movement including a movement relative to the axis of the shaft 35, and to oscillate the needle bar 45 in synchronism with movements of the takeup member 36 by way of the link 43. The link 41 can be replaced with or can form part of a disc.

Figure 2:
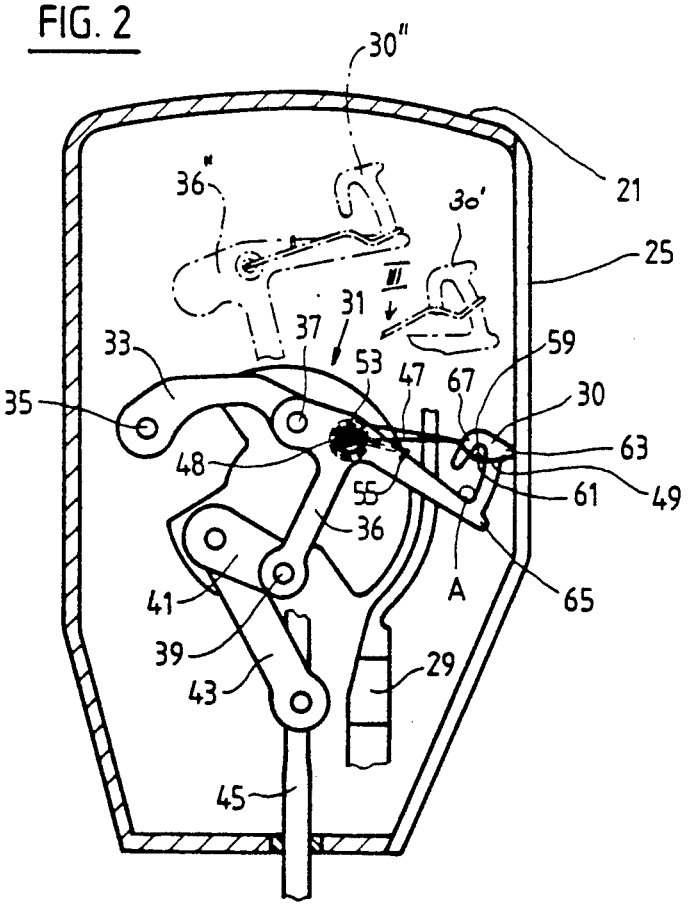
FIG. 2 is an enlarged transverse vertical sectional view of the upper arm, substantially as seen in the direction of arrows from the line II—II of FIG. 1.
Figure 3:
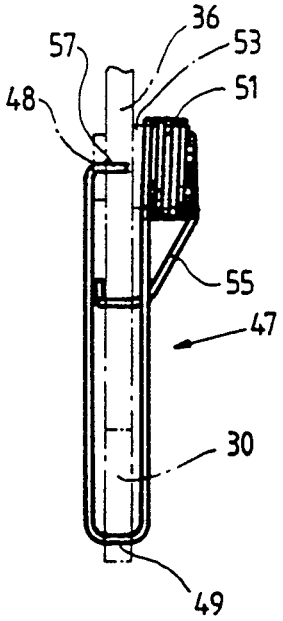
FIG. 3 is an enlarged plan view of the thread tightening spring substantially as seen in the direction of arrow III in FIG. 2.

The means (including the links 41, 43) for moving the takeup member 36 of the regulating mechanism 31 in synchronism with the needle 19 is designed in such a way that (in the embodiment which is shown in FIG. 2) the hook-shaped pallet 67 of the arm 30 is invariably located within the confines of the head 21 in each position of the arm 30. This renders it possible to provide a relatively sensitive tightening member 47 which forms part of the regulating mechanism 31 and is mounted directly on and thus shares the movements of the takeup member 36. The tightening member 47 is a spring which is made of steel wire or other suitable springy material and includes an annular portion 51 which is made of neighboring convolutions of wire and is slipped onto a protuberance 53 (here shown as a cylindrical stud) of the takeup member 36. The protuberance 53 is located at the junction of the three arms of the takeup member 36 and one of its ends is provided with a socket 48 (such as a blind axial bore or hole) for one end or tip 57 of a U-shaped thread engaging portion 49 of the spring 47. The arrangement is such that the pallet 67 of the thread engaging arm 30 of the takeup member 36 (shown in FIG. 3 by phantom lines) is located within the U-shaped thread engaging portion 49 of the spring 47. The pallet 67 and the adjacent part of the U-shaped portion 49 define a passage 59 for confinement of a portion of the needle thread 61 between the tensioning device 29 and the eye of the needle 19.

An end portion 55 of the spring 47 is bent several times to surround an adjacent portion of the takeup member 36 and to thus prevent rotation of the annulus 51 of convolutions about the protuberance 53 of the member 36. A part of the end portion 55 extends tangentially of the outermost convolution of the annulus 51. This annulus is disposed between the end portion 55 and the U-shaped thread engaging portion 49. The free end or tip 57 of the thread engaging portion 49 is bent over so that it can extend into the aforementioned socket 48 of the takeup member 36. As mentioned above, the socket 48 can constitute a bore or hole in the respective end portion of the protuberance 53.

That part of the U-shaped portion 49 which surrounds the pallet 67 of the thread engaging arm 30 is preferably V-shaped (see FIG. 2) and its bight is located between two spaced-apart stops 63, 65 of the thread engaging arm 30 of the takeup member 36. The deepmost region of the V-shaped part of the U-shaped portion 49 cooperates with the hook-shaped pallet 67 of the arm 30 to define the aforementioned passage 59 for a portion of the needle thread 61. The thread 61 is guided from the spool 11, through the slot 23, through the tensioning device 29, through the slot 25, through the regulating mechanism 31 and on to the eye of the needle 19.

FIG. 2 shows that the stops 65, 63 of the thread engaging arm 30 are adjacent the slot 25 in the head 21 of the upper arm 5. The purpose of these stops is to determine the upper and lower limits (i.e., the extent) of movability of the U-shaped thread engaging portion 49 of the spring 47 relative to the arm 30 and vice versa. When the bight of the U-shaped portion 49 abuts the lower stop 65, the portion 49 and the pallet 67 are at least slightly spaced apart from each other to facilitate convenient introduction of a portion of needle thread 61 into the then open passage 59. Such introduction of needle thread 61 into the passage 59 (between the tip of the pallet 67 and the U-shaped portion 49 while the bight of the portion 49 abuts the lower stop 65) will take place prior to start of a sewing operation.

The upper arm 5 further carries and/or confines one or more standard thread guides which ensure that the needle thread 61 is advanced from the spool 11 to the tensioning mechanism 29 and thence into the passage 59 by moving along a predetermined path. One or more guides can be provided at the upper side 20 of the upper arm 5. Once a portion of the needle thread 61 is caused to extend through the passage 59 (preferably subsequent to movement of the bight of the thread engaging portion 49 of the spring 47 against the lower stop 65 of the arm 30), the regulating mechanism 31 establishes a predetermined path for advancement of the thread 61 from the passage 59 to the eye of the needle 19. Furthermore, once the U-shaped portion 49 moves toward the stop 63 so that it surrounds the pallet 67, the thread 61 is confined in the passage 59 because the latter is then closed from below and permits the thread 61 to advance therethrough only in a direction at right angles to the plane of FIG. 2.

The first stage of a stitch forming step includes a downward movement of the needle 19 from a raised position toward the fabric 4 on the lower arm 3 of the sewing machine 7. The takeup member 36 of the regulating mechanism 31 also moves downwardly but at a speed exceeding the speed of downward movement of the needle 19 and its bar 45. This causes the development of a length of loose needle thread 61 between the eye of the needle 19 and the thread engaging arm 30 of the takeup member 36. Such length of loose needle thread 61 is taken up by the thread engaging portion 49 of the tightening spring 47 to such an extent that the thread is subject to a certain (relatively small) amount of tension. The U-shaped thread engaging portion 49 of the spring 47 can take up needle thread only until it comes into engagement with the stop 63 of the descending arm 30, At such time, the lower end portion of the needle 19 has penetrated into the fabric 4 so that the lower end portion of the needle cannot catch loose needle thread and the thread cannot be twisted immediately ahead of the eye in the lower end portion of the needle. The looptaker (not shown) in the lower arm 3 of the machine 7 then engages the needle thread loop, which has been formed at the eye of the needle in the conventional manner, to enlarge the loop and to place it around the looptaker on the bobbin case in the arm 3. Reference may be had to commonly owned U.S. Pat. No. 4,724,782 to Reber and to FIG. 6A of the aforementioned U.S. Pat. No. 4,856,443. This results in practically complete exhaustion of the supply of loose needle thread 61 between the takeup member 36 in the head 21 of the upper arm 5 and the fabric 4 on the lower arm 3. As soon as the looptaker has cast the enlarged loop of needle thread 61 and the spring 47 entrains the freshly loosened needle thread 61 in upward direction as a result of counterclockwise pivotal movement (as seen in FIG. 2), the takeup member 36 also begins to move upwardly (toward the position 36" of FIG. 2) whereby the U-shaped portion 49 initially stores a maximum possible amount of needle thread. There is no longer any loose needle thread between the fabric 4 and the takeup member 36 when the takeup member 36 approaches the upper end position 36" so that the member 36 can tighten the freshly formed stitch in the fabric 4 and can simultaneously draw a length of needle thread 61 from the spool 11 (to store the freshly drawn needle thread for the next stitch forming step) during the last stage of movement to the upper end position 36". When the needle thread 61 is taut (in the position 36" of the takeup member 36), it engages the arm 30 of the takeup member 36 at the location A.

An important advantage of the improved regulating mechanism 31 is its simplicity. In addition, the mechanism 31 can reliably take up loose needle thread 61 above the eye of the needle 19 during all, or practically all, stages of each stitch forming step.

Simplicity of the regulating mechanism 31 is attributable to the feature that the spring 47 is mounted directly on and shares the movements of the takeup member 36 under the action of moving means including the links 41 and 43. The spring 47 can be used as a component part of the means for guiding the needle thread 61 and can ensure that the extent to which the thread 61 is looped changes little or not at all, i.e., the extent of frictional engagement between the thread 61 and the portion 49 is substantially constant irrespective of the momentary position of the member 36 and/or needle 19.

An advantage of the convoluted portion 51 of the spring 47 and of the preferably cylindrical stud-shaped protuberance 53 of the takeup member 36 is that it is not necessary to provide discrete means for securing the spring to the takeup member; all that is necessary is to slip the convolutions of the portion 51 onto the protuberance 53, to place the end portion 55 into engagement with the adjacent portion of the member 36 so that the portion 49 is biased in a counterclockwise direction, and to introduce the bent-over end or tip 57 into the socket 48. Once it is properly mounted on the takeup member 36, the spring 47 invariably ensures that the needle thread 61 is properly tightened as soon as the thread tends to become slack and/or that the thread is pinched in the passage 59.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a sewing machine, a needle having an eye for needle thread; means for reciprocating the needle so that the needle alternatingly moves toward and into and thereupon away from a material to be sewn; and means for regulating the supply of needle thread between a source of needle thread and the needle, comprising a mobile thread takeup member, means for intermittently tightening the thread at said takeup member, said tightening means comprising a spring mounted directly on and sharing the movements of said takeup member while the needle is being moved toward and into a material to be sewn, said takeup member and said spring comprising thread engaging portions defining a passage for needle thread and said thread engaging portion being movable relative to each other, and means for limiting the extent of movability of said thread engaging portions relative to each other.

2. The structure of claim 1, further comprising means for tensioning the needle thread between the source and said regulating means.

3. The structure of claim 1, wherein said regulating means further comprises means for moving said takeup member in synchronism with the needle.

4. The structure of claim 3, wherein said moving means comprises a link train.

5. The structure of claim 1, wherein said regulating means further comprising means for imparting substantially translatory movements to said takeup member and said spring.

6. The structure of claim 1, wherein said takeup member includes a protuberance and said spring includes a second portion which is non-rotatably mounted on said protuberance.

7. The structure of claim 6, wherein said protuberance includes a substantially cylindrical stud and said second portion of said spring surrounds said stud.

8. The structure of claim 7, wherein said second portion of said spring consists of wire and includes an annulus of convolutions, said annulus being slipped onto said stud.

9. The structure of claim 8 wherein said spring further comprises an end portion extending from said annulus and at least partially surrounding a portion of said takeup member.

10. The structure of claim 1, wherein one of said thread-engaging portions is located within the other of said thread engaging portions.

11. The structure of claim 1, wherein the thread engaging portion of said spring is substantially U-shaped and surrounds the thread engaging portion of said takeup member.

12. The structure of claim 1, wherein said takeup member has a socket and said thread engaging portion of said spring has a tip extending into said socket.

13. Structure of claim 12, wherein said socket is an axial hole in a stud of said takeup member and said tip includes a bent-over free end of the thread engaging portion of said spring.

14. The structure of claim 1, wherein the thread engaging portion of said takeup member comprises a pallet and the thread engaging portion of said spring cooperates with said pallet to define said passage.

15. The structure of claim 14, wherein said pallet is hook-shaped.

16. The structure of claim 14, wherein said thread-engaging portion of said spring surrounds said pallet to confine a portion of needle thread in said passage.

17. In a sewing machine, a needle having an eye for needle thread; means for reciprocating the needle; and means for regulating the supply of needle thread between a source of needle thread and the needle, comprising a mobile thread takeup member and means for intermittently tightening the thread at said takeup member, said tightening means comprising a spring mounted directly on and sharing the movements of said takeup member, said takeup member including a protuberance and said spring including a portion which is non-rotatably mounted on said protuberance, said takeup member and said spring comprising thread engaging portions defining a passage for needle thread, the thread engaging portion of said spring being substantially U-shaped and surrounding the thread engaging portion of said takeup member, said regulating means further comprising means for moving said takeup member in synchronism with the needle and said moving means comprising a linktrain.

18. The structure of claim 17, wherein said protuberance includes a substantially cylindrical stud and said non-rotatably mounted portion of said spring surrounds said stud, said non-rotatably mounted portion of said spring consisting of wire and including an annulus of convolutions, said annulus being slipped onto said stud.

19. The structure of claim 17, wherein said protuberance has a substantially centrally located socket and said thread engaging portion of said spring has a tip extending into said socket.

* * * * *